US007798830B2

(12) United States Patent
Schneider et al.

(10) Patent No.: US 7,798,830 B2
(45) Date of Patent: Sep. 21, 2010

(54) ELECTRICAL SWITCH AND OUTLET DESIGN THAT CAN BE SAFELY REPLACED WITH THE POWER ON AND WITHOUT TOOLS

(75) Inventors: Scott Schneider, New York, NY (US); Brandon Jarvis, New York, NY (US); David Cowan, Brooklyn, NY (US)

(73) Assignee: Qwick Systems, LLC, New York, NY (US)

( * ) Notice: Subject to any disclaimer, the term of this patent is extended or adjusted under 35 U.S.C. 154(b) by 0 days.

(21) Appl. No.: 12/209,660

(22) Filed: Sep. 12, 2008

(65) Prior Publication Data

US 2009/0075505 A1 Mar. 19, 2009

(51) Int. Cl.
*H01R 13/62* (2006.01)

(52) U.S. Cl. ..... 439/157; 439/923; 439/372

(58) Field of Classification Search ..... 439/157, 439/153, 160, 923, 372
See application file for complete search history.

(56) References Cited

U.S. PATENT DOCUMENTS 2,672,593 A * 3/1954 Shenton ..... 439/107
3,054,023 A * 9/1962 Blecker et al. ..... 361/600
3,727,110 A * 4/1973 Sopko et al. ..... 361/600
3,746,931 A * 7/1973 Muranaka ..... 174/503
5,174,785 A * 12/1992 Endo et al. ..... 439/489
6,183,275 B1 * 2/2001 Okura et al. ..... 439/157
6,361,336 B1 * 3/2002 Zhao et al. ..... 439/157
2009/0047812 A1 * 2/2009 Deno et al. ..... 439/157

* cited by examiner

*Primary Examiner*—Tho D Ta
*Assistant Examiner*—Travis Chambers
(74) *Attorney, Agent, or Firm*—Levisohn Berger LLP

(57) ABSTRACT

An electrical switch and outlet design which includes a modular electrical component system having a universal connector which can receive replacement switches, sockets and other electrical components. The connection between these switches, sockets or other components and the universal connector is controlled by a lifting system in which the entirety of the replacement module is inserted into a receptacle or removed therefrom without the user touching any electrical wiring. Essentially, components are changed by plugging a component into and unplugging one from a universal grounded connector.

12 Claims, 6 Drawing Sheets

ELECTRICAL SWITCH AND OUTLET DESIGN THAT CAN BE SAFELY REPLACED WITH THE POWER ON AND WITHOUT TOOLS

FIELD OF THE INVENTION

The present invention (the "Invention") relates to the increased ease and safety that a modular design for electrical switches and outlets brings to the procedure of installing and replacing such devices.

BACKGROUND

Most homes and many commercial spaces, especially hospitals, require the replacement of light switches, outlets and other electrical controls from time to time due to wear and tear, a need for additional or different functionality, or just a style or color change. All conventional light switches and outlets are attached directly to a building's electrical wiring. When a conventional switch or outlet needs to be replaced, first the fuse or breaker must be located and turned off, only then can the wall plate be removed, the device unscrewed from its electrical box and the wiring to the switch disconnected. Once this has been accomplished, a device can be installed following the same procedure in reverse: attaching the wiring, screwing the device into the electrical box and installing the wall plate, and finally restoring the fuse or breaker. The power leading to the old device must be turned off at the fuse box before disconnecting it, otherwise the person replacing it runs the risk of electrical shock and possibly electrocution. Also, many of today's advanced dimmers, timers and motion sensors are susceptible to damage when the power is removed and later restored to the device.

The Invention relates to a modular electrical component system that reduces the overall danger, total time required, likelihood of error and aggregate cost of changing a light switch, while also decreasing the complexity of initially wiring a building's electrical system. The Invention makes changing a switch, dimmer, motion sensor, timer, etc (each, a "Component") as simple and safe as plugging in a power cord, allowing the average homeowner to safely do it themselves. The Invention eliminates the need for professional involvement (subsequent to the original installation) insofar as it allows the consumer to change. Components by plugging a Component into (and unplugging it from) a universal grounded connector that generally resembles a standard electrical outlet. The universal connector eliminates the need to unscrew anything or manipulate any wires. Instead, consumers can make the improvement through a safe and easy insertion or removal action without fear of damage to the wiring, shock or electrocution. The Invention is attractive not only to the homeowner, but also to the contractor and builder. The universal connector has been designed in a way that reduces installation time and complexity, while providing real utility and convenience to the homeowners, saving them money over time as they continue to make upgrades and design changes themselves instead of employing an electrician. The Invention is also fully compatible with "smart"-home applications, such as Insteon, X10 and others.

SUMMARY OF THE INVENTION

The Invention presents clear advantages over the prior art by offering an easy-to-use, safe and expedient way to replace Components.

In some ways, the Invention is revolutionary in that an entirely different methodology is employed to carry a building's electrical power to switches and sockets, which can be readily changed by a homeowner, who merely plugs-in or removes replacement Components by operating the lifting mechanism. There is no reasonable way that the homeowner can be endangered, and this safe and simple invention can pave the way for a great expansion of different Components to be used by homeowners as desired.

DETAILED DESCRIPTION OF THE PREFERRED EMBODIMENT

Figure 1:
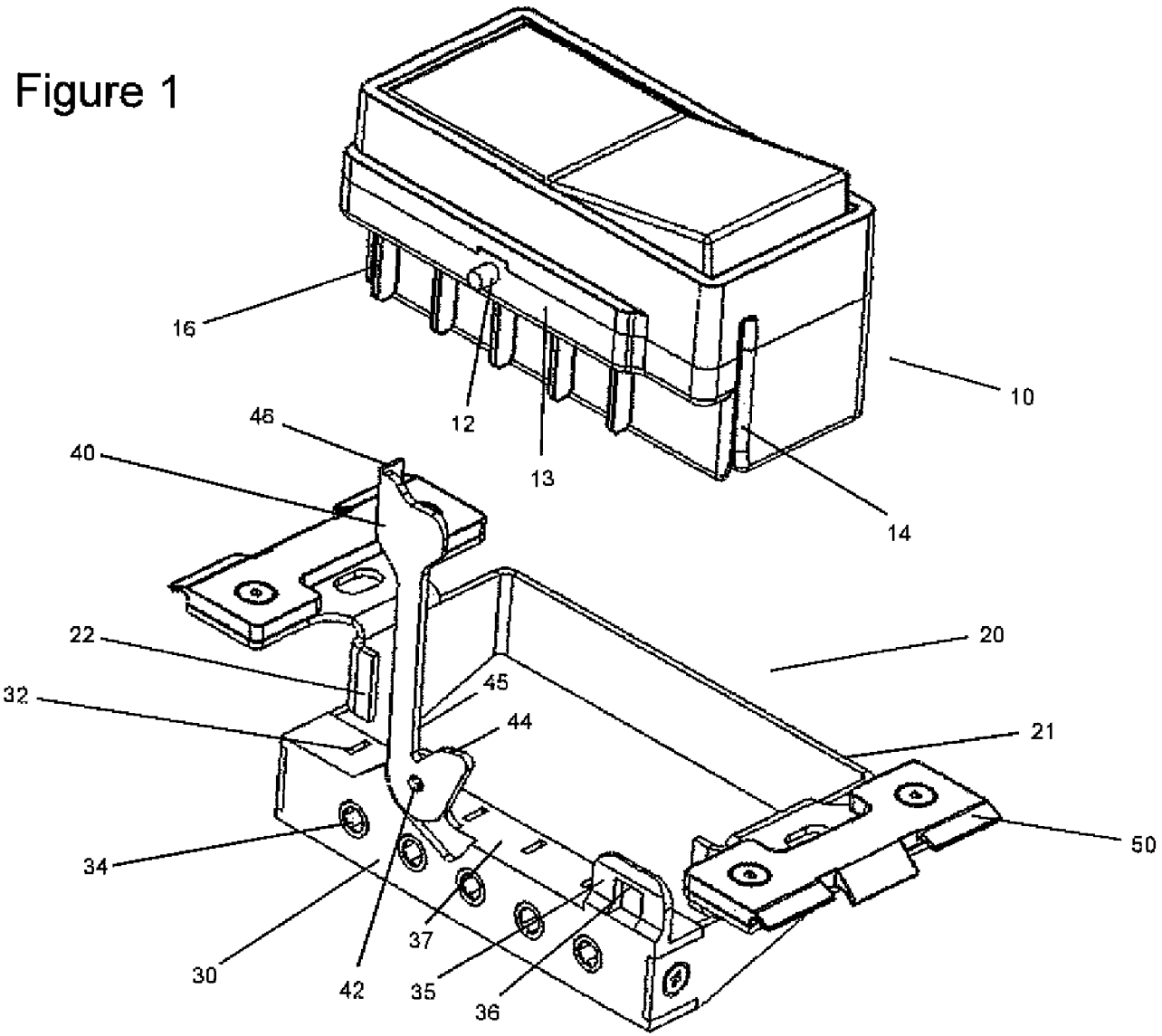
FIG. 1 is a side perspective view of a first embodiment of the Invention, including a modular component (switch) and a universal connector.
Figure 3:
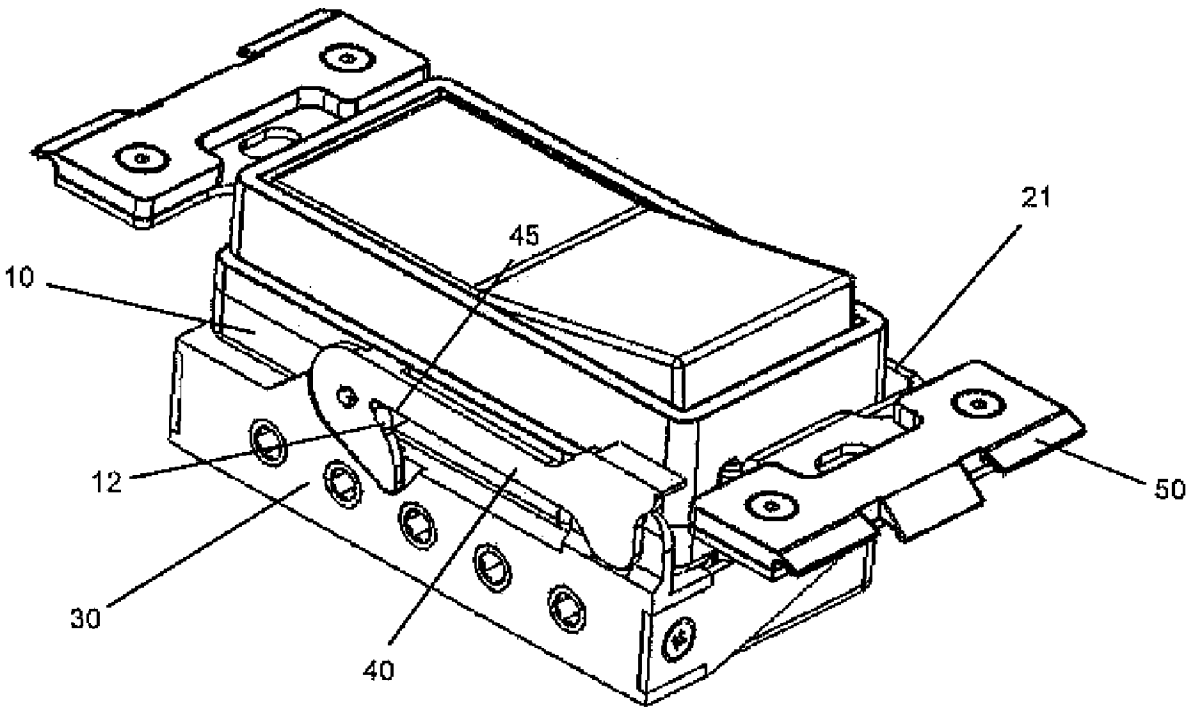
FIG. 3 is the same side perspective view as FIG. 1, with the modular component fully engaged with, and latched to, the universal connector.
Figure 6:
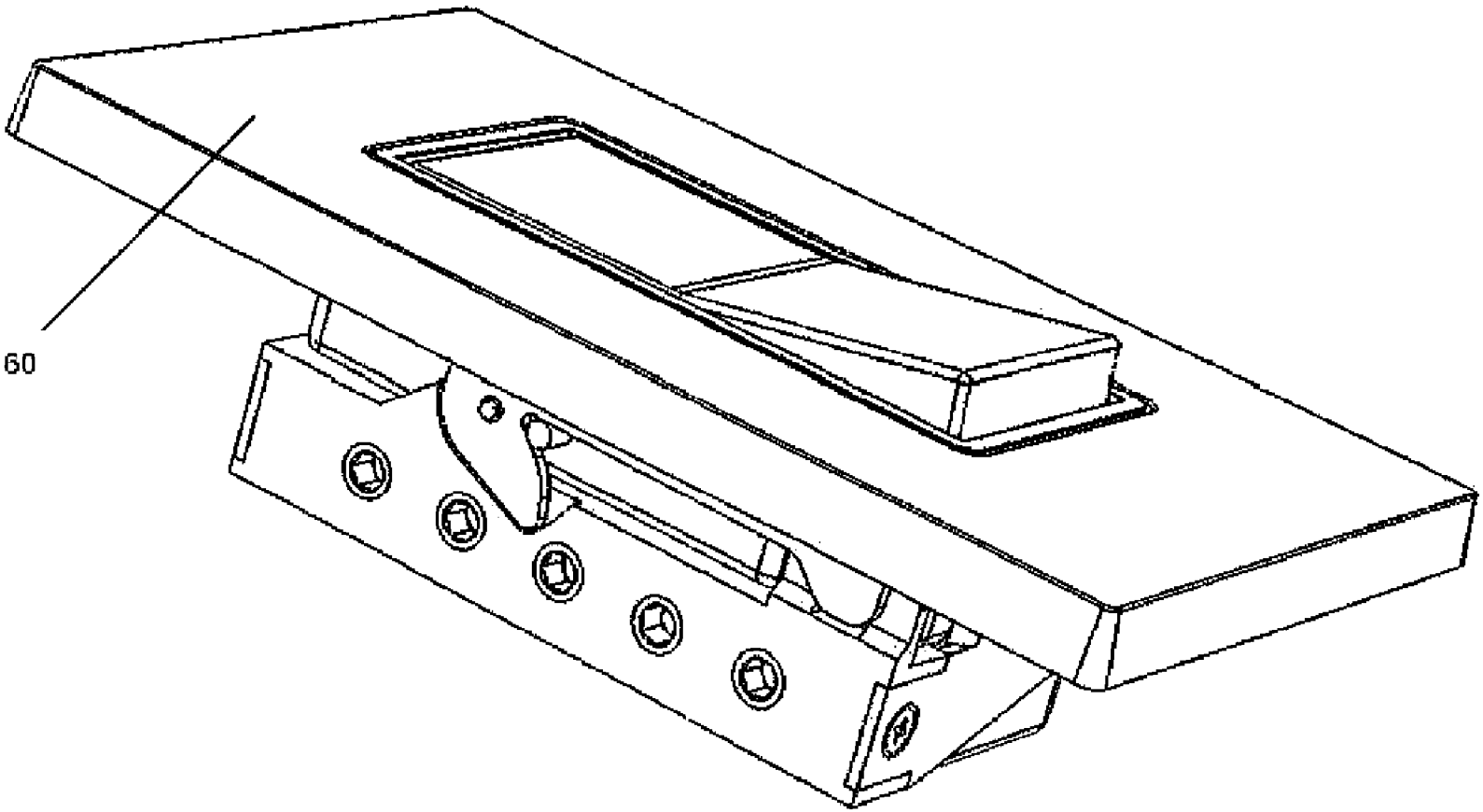
FIG. 6 is a perspective view of the wall plate.

Referring to the drawings, FIG. 1 is a side perspective view of modular component 10 being vertically aligned with universal grounded connector 20. Modular component includes vertical slots 14 that help to align the modular component with the universal grounded connector, which ensures that the module's electrical contacts align with the connector's contacts, and that the module does not bind as it is moved into full engagement. There are five male plugs 16 extending downward from the modular component that can connect with the five female receptacles 32 that are part of the universal connector, and are located in the top surface of the termination housing 30. The universal connector also includes a lifting system comprised of latching lever 40 with cam shaped surface 44 and retaining surface 45, and pivot 42. Peg 12 extends perpendicular to one side 13 of the modular component and can engage with a latching lever 40, both to draw the component into the universal grounded connector, and to lift and eject it. A pair of levels could also be used to accomplish the same lifting and latching. Universal grounded connector 20 includes "U"-shaped chassis 21, and termination housing 30. The chassis 21 has guiding tabs 22 oriented vertically near termination housing 30. The termination housing includes five fasteners 34 on its side that are used to capture and make an electrical connection with the building's circuits or wiring wires that are inserted from below. These wires may include ground, neutral, hot, and special wiring like that required for 3-way and 4-way switching. This simple five-in-a-row configuration of the termination for all potential modules provides, for the first time, a consistent wiring arrangement for switches, outlets and all other electrical devices. This consistency will have a positive effect on reducing mistakes in wiring and will speed up the process of wiring hundreds of switches and outlets in a home, and thousands in a commercial building. Tab 35 is substantially rectangular and extends vertically from a top surface 37 of the termination housing. Tab 35 provides a downward facing, horizontal surface 36 for the latching lever 40 to engage with (FIG. 3). The latching lever rotates about pivot 42 which is fixedly attached to a surface 39 projecting upwardly from the top surface 37 of the termination housing. A cam shaped surface 44, integrally formed as part of lever 40, acts on peg 12 to lift and eject modular component 10. Retaining surface 45 of lever 40 acts on the peg to pull the modular component into the universal grounded connector, and prevents it from disengaging. The latching lever 40 includes a push tab 46, a thin flange integrally formed as part of lever 40, extending beyond the end of the lever, that is positioned and sized to make it easy to push down to latch, or to lift with a finger or a small screwdriver since the orientation and location of the push tab is forward of the connector 20 (FIG. 3) when the modular component 10 is seated into the connector 20. There are four flexible tabs 50 positioned at opposite corners of the chassis that snap into receiving openings in a decorative wall plate (FIG. 6).

Figure 2:
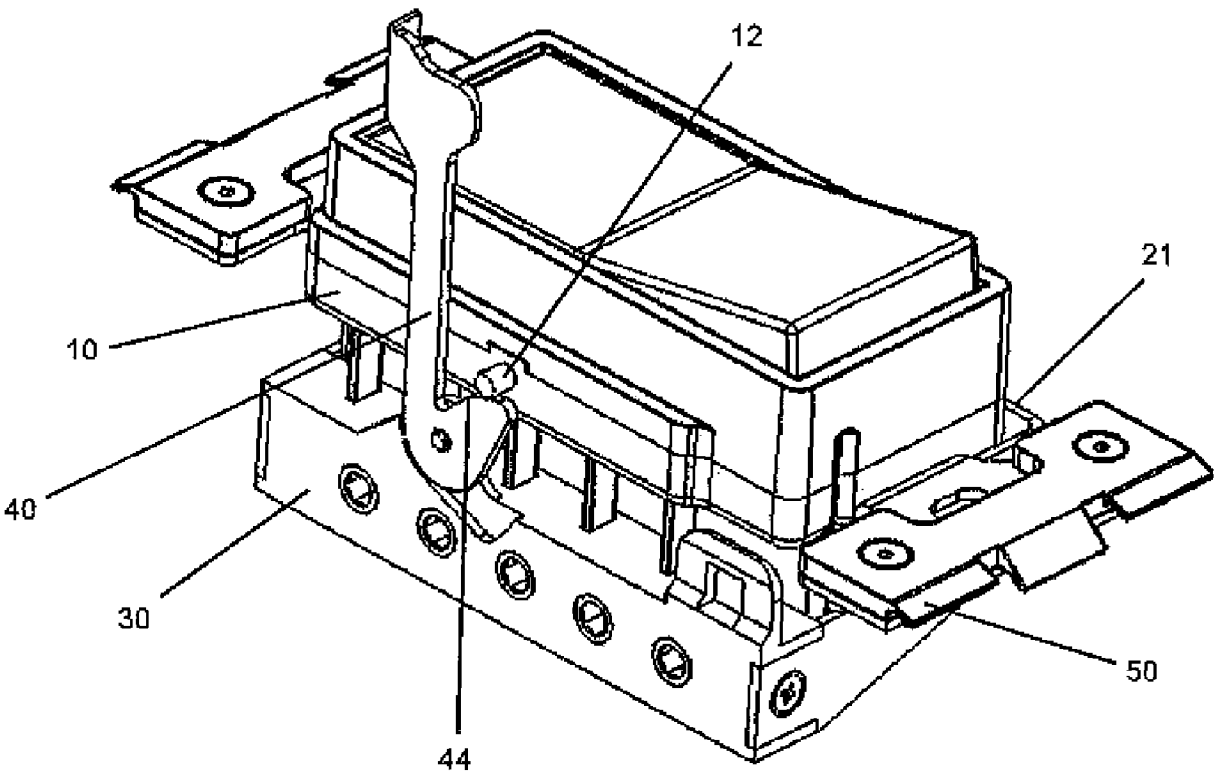
FIG. 2 is the same side perspective view as FIG. 1, with the modular component more engaged with the universal connector.

FIG. 2 is the same side perspective view as in FIG. 1, illustrating the modular component being more engaged with the universal grounded connector. The asymmetries of the modular component and of the connector make it impossible for the component to be installed incorrectly. These asymmetries include the 5 male plugs, and the 2 vertical slots with the corresponding guiding tabs that are both on the same side of the centerline of the assembly. Either one of these asymmetries would be sufficient to prevent incorrect installation. The male plugs 16 have begun to engage with the female receptacles 32. The male plug that will carry ground may be slightly longer than the other male plugs to ensure that the ground circuit is complete before other connections are made. Peg 12 of the modular component is in contact with the cam shaped surface 44 of the latching lever.

FIG. 3 is again the same side perspective view as in FIG. 1, this time disclosing the modular component fully engaged with the universal grounded connector. Peg 12 is now captured by the retaining surface 45 of the latching lever, ensuring that the modular component cannot come loose, potentially interrupting electrical contact with the universal grounded connector.

Figure 4:
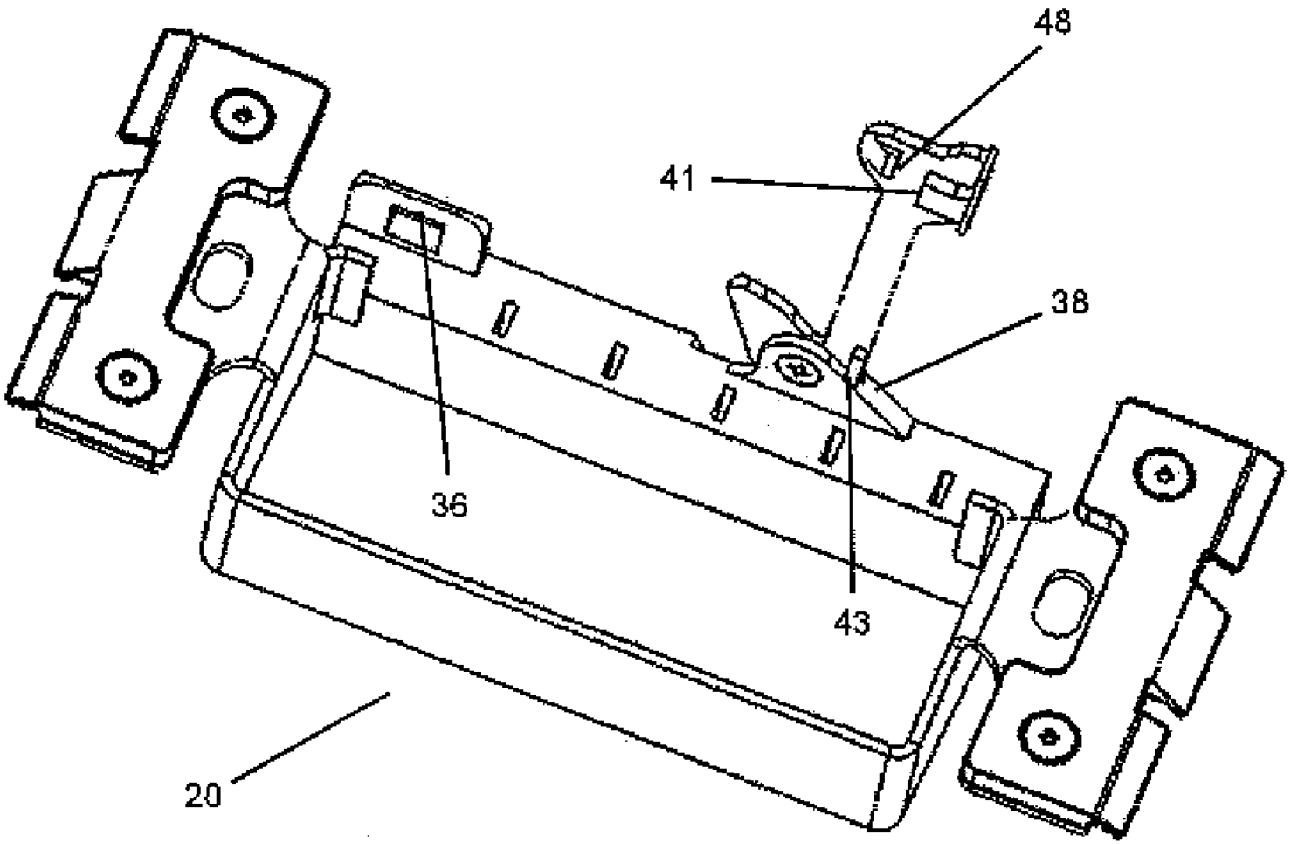
FIG. 4 is a top perspective view of the universal connector.

FIG. 4 is a top perspective view disclosing the features of the lifting system's latching lever that were not visible in the previous figures. When the latching lever is latched closed, as in FIG. 3, the ramp shaped catch 48 will be engaged with and prevented from upward motion, by horizontal surface 36. To disengage the latching lever, it can be bent outward away from the modular component, in a direction perpendicular to its plane of motion. The latch pivot rib 38 extends vertically upward from the top surface of the termination housing and is a stop-surface for stop tab 43, which extends off the inside surface of the lever towards the modular component, and ensures that the lever cannot be rotated too far, which could make it difficult to insert the module. Stop block 41 is located next to the ramp shaped catch and extends off the inside surface of the lever. This stop block can contact tab 35, but cannot go further, which keeps the latch from being pushed beyond the fully engaged and latched position.

Figure 5:
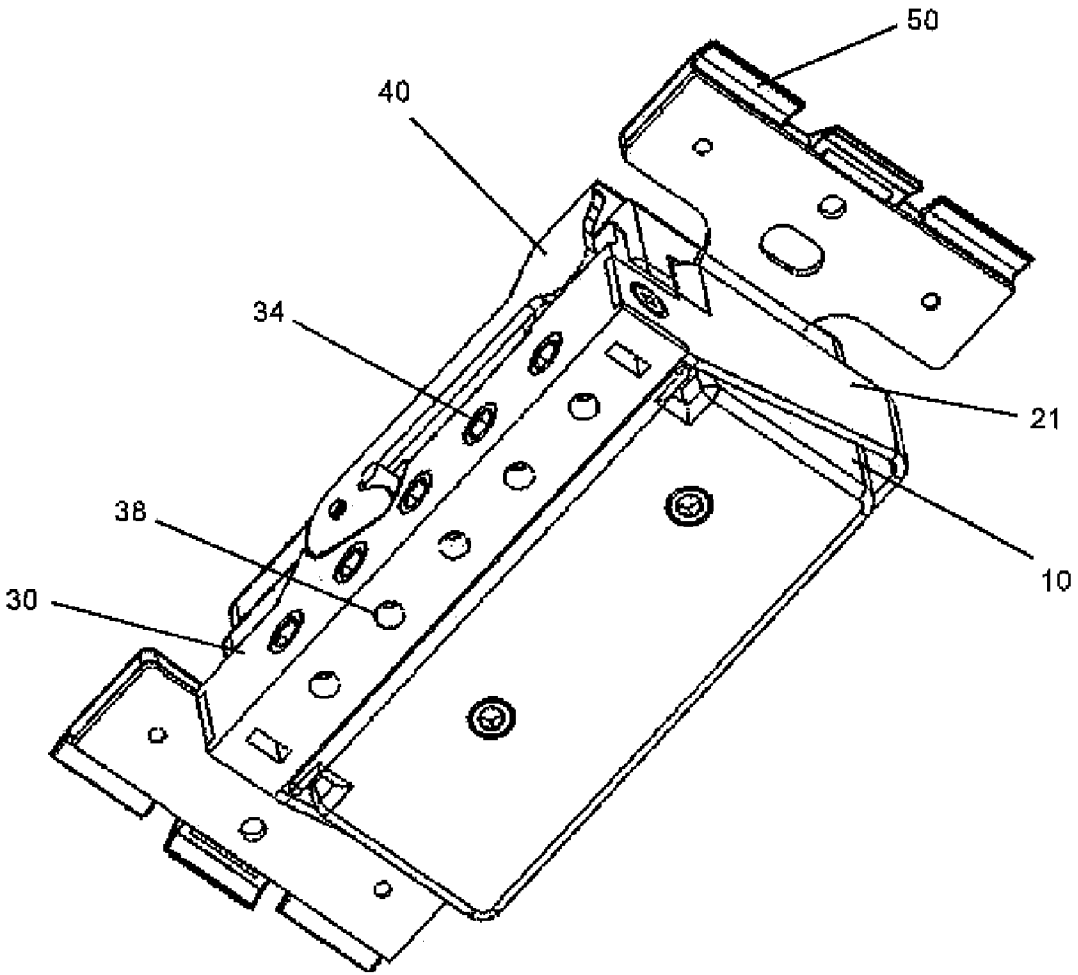
FIG. 5 is a bottom perspective view of the universal connector.

FIG. 5 is a bottom perspective view of the universal grounded connector disclosing the termination housing's rear surface and its five electrical terminals 38 that a building's electrical wiring is connected to. These electrical terminals connect the building's wiring to the female receptacles of the housing. The female receptacles are integrally formed in the electrical terminals. The orientation and placement of these terminals makes them easy to attach wires to, and difficult for a consumer to accidentally touch an unprotected wire. FIG. 5 also illustrates how the open-center design of this universal grounded connector makes it possible for the modular component to have almost any depth. This flexibility allows a single design for the universal grounded connector to be small and thin to fit in the smallest junction box when holding a simple switch, and also capable of accepting more sophisticated modular components such as a dimmer, motion sensor or timer that have relatively large circuit boards inside and subsequently will be larger modular components requiring greater depth.

FIG. 6 is a side perspective view showing the modular component fully engaged with the grounded universal connector and a wall plate 60 engaged with the universal connector and covering the modular component.

The Invention is presented as connected to a building's wiring. The term building, whenever used herein, generically relates to any structure, including, but not limited to, a building, a boat, a dock or any other structure which contains wiring to be distributed at sockets throughout a space or spaces.

It should be understood that the preferred embodiment was described to provide the best illustration of the principles of the Invention and its practical application to thereby enable one of ordinary skill in the art to utilize the Invention in various embodiments and with various modifications as are suited to the particular use contemplated. All such modifications and variations are within the scope of the Invention as determined by the appended claims when interpreted in accordance with the breadth to which they are fairly, legally and equitably entitled.

The invention claimed is:

1. A modular electrical socket component system to be electrically connected to a structure's electrical wiring, said component system comprising:

a universal grounded connector having a housing, said universal grounded connector being connected to said structure's electrical wiring to deliver standard electrical power to said component system, said housing of said universal connector having a rear surface with electrical terminals connected to said structure's electrical wiring, said connector further comprising a female receptacle connected to said housing, said female receptacle connected with said electrical terminals to provide electrical power at said female receptacle, said structure's electrical power being connected to said electrical terminals to block accessibility of consumers to said structure's electrical wiring, said modular component comprising a male plug to fit in said female receptacle, and a lifting system connected to said housing for capturing said modular component and guiding said male plug into and out of said female receptacle to make electrical contact therebetween or to eject said male plug therefrom, said lifting system positively urging said male plug into or out of said female receptacle, said lifting system locking said male plug in place in said female receptacle and ejecting said male plug from said female receptacle by manual pressure applied to said lifting system to perform either of said functions of connecting or disconnecting said male plug and female receptacle, said female receptacle being integrally formed with said electrical terminals, said modular component has a front and a rear, said male plug being located at said rear of said modular component, said electrical power being connected to said electrical terminals at said rear surface of said housing, and wherein the distance between said front and said rear of said modular component comprises its depth, wherein said housing has a depth sufficient to enable the front of said modular component to be substantially in the same plane as the wall in which said system is located.

2. A modular electrical socket component system according to claim 1, wherein said lifting system is asymmetrical to permit only one orientation of said modular component as it interacts with said female receptacle.

3. A modular electrical socket component system according to claim 1, wherein said lever comprises a lever hook, said housing comprising at least one peg engaged by said lever hook, in which said peg is moved by said lever hook to either lock said male plug within said female receptacle or release such connection to permit removal of said component system.

4. A modular electrical socket component system according to claim 1, wherein said component system is selected from a group of a wall switch, a dimmer, a motion sensor or a timer.

5. A modular electrical socket component system according to claim 1, wherein said component system is compatible with smart home appliances.

6. A modular electrical socket component system according to claim 1, wherein said male plug includes a ground prong and conventional plug prongs, wherein said ground prong is slightly longer than said plug prongs to establish a ground connection before making live electrical power connections.

7. A modular electrical socket component system according to claim 1, wherein said structure is a building.

8. A modular electrical socket component system according to claim 1, wherein said lifting system comprises at least one lever located on one side of said housing between said housing and said modular component.

9. A modular electrical socket component system according to claim 8, wherein said lifting system comprises a pair of levers located on opposite sides of said housing.

10. A modular electrical socket component system according to claim 9, wherein said levers comprise a push tab surface for easy manual manipulation of said levers to lock said male plug in said female receptacle or to eject said male plug therefrom.

11. A modular electrical socket component system according to claim 1, wherein said electrical terminals comprise a plurality of terminal connectors connected in a row to terminate modules connected to said connector.

12. A modular electrical socket component system according to claim 11, wherein said plurality comprises five in a row configuration of said electrical terminals.

* * * * *